US009413124B2

(12) United States Patent
Riccardi

(10) Patent No.: US 9,413,124 B2
(45) Date of Patent: Aug. 9, 2016

(54) TELECOMMUNICATION OR DATA-TRANSMISSION JACK

(71) Applicant: Wilhelm Rutenbeck GmbH & Co.KG, Schalksmuehle (DE)

(72) Inventor: Oliver Riccardi, Schalksmuehle (DE)

(73) Assignee: WILHELM RUTENBECK GMBH & CO. KG, Schalksmuehle (DE)

( * ) Notice: Subject to any disclaimer, the term of this patent is extended or adjusted under 35 U.S.C. 154(b) by 0 days.

(21) Appl. No.: 14/809,593

(22) Filed: Jul. 27, 2015

(65) Prior Publication Data

US 2016/0036178 A1 Feb. 4, 2016

(30) Foreign Application Priority Data

Aug. 4, 2014 (DE) ..... 10 2014 111 049

(51) Int. Cl.
*H01R 24/00* (2011.01)
*H01R 24/64* (2011.01)
*H01R 12/62* (2011.01)

(52) U.S. Cl.
CPC ..... *H01R 24/64* (2013.01); *H01R 12/62* (2013.01)

(58) Field of Classification Search
CPC ..... H01R 13/6658; H01R 4/2433; H01R 9/0757; H01R 23/025; H01R 13/661601; H01R 23/005
USPC ..... 439/76.1, 404, 405, 620.01, 620.17, 439/620.21–620.23, 676, 941
See application file for complete search history.

(56) References Cited

U.S. PATENT DOCUMENTS 7,252,554 B2 * 8/2007 Caveney ..... H05K 1/0228 439/676
7,281,957 B2 * 10/2007 Caveney ..... H01R 13/6658 439/676
7,357,683 B2 * 4/2008 Caveney ..... H01R 13/6658 439/676
7,601,034 B1 * 10/2009 Aekins ..... H01R 13/6464 439/676
7,850,492 B1 * 12/2010 Straka ..... H01R 13/6625 439/676
7,914,345 B2 * 3/2011 Bopp ..... H01R 13/6467 439/676
7,967,645 B2 * 6/2011 Marti ..... H01R 13/6658 439/676
8,425,255 B2 * 4/2013 Erickson ..... H01R 13/6464 439/620.22
8,650,750 B2 * 2/2014 Engels ..... H01R 13/6585 29/857
8,936,494 B2 * 1/2015 Weinmann ..... H01R 13/6466 439/620.17
8,998,650 B2 * 4/2015 Ku ..... H01R 24/64 439/676

FOREIGN PATENT DOCUMENTS

DE 102004011358 A 11/2005

* cited by examiner

*Primary Examiner* — Thanh Tam Le
(74) *Attorney, Agent, or Firm* — Andrew Wilford

(57) ABSTRACT

A jack has a housing and connectors. A dielectric housing part forms with the housing an upwardly open seat shaped to receive and fit with a substantially complementary plug. A second flexible circuit board has a U-shaped outer end formed with a plurality of conductive jack fingers projecting into the seat. The jack fingers are connected via the first circuit board to the connectors. A U-shaped dielectric support fits complementarily within the U-shaped end of the second circuit board, has fingers like the jack fingers and fixed thereto, and is pivotal in the housing part between an inner position and an outer position. A U-shaped leaf spring fits within the support, has fingers like the support fingers, bears outwardly on the support, and is braced against the housing part to bias the jack fingers into the outer position.

6 Claims, 5 Drawing Sheets

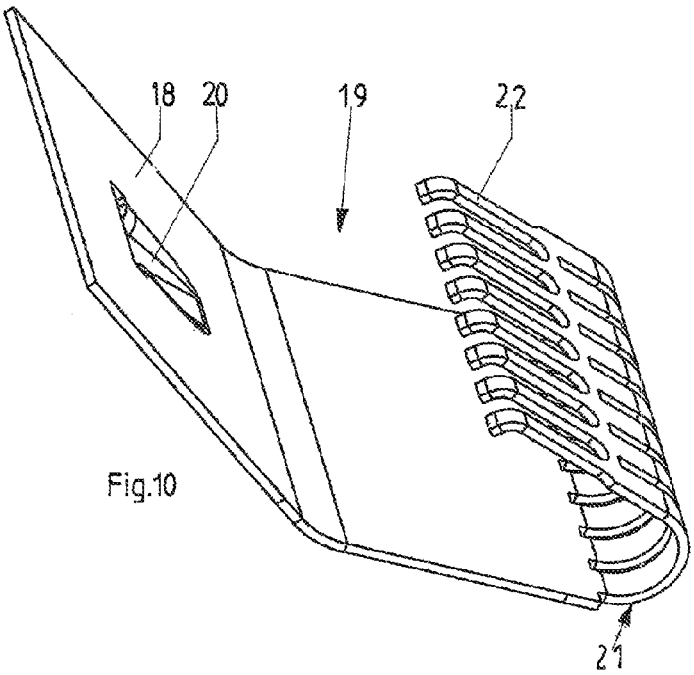
Fig.10
Fig.11
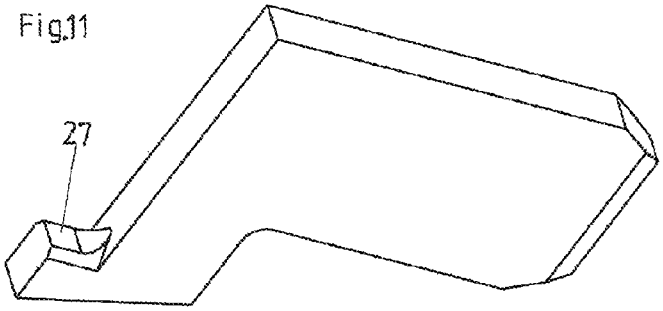
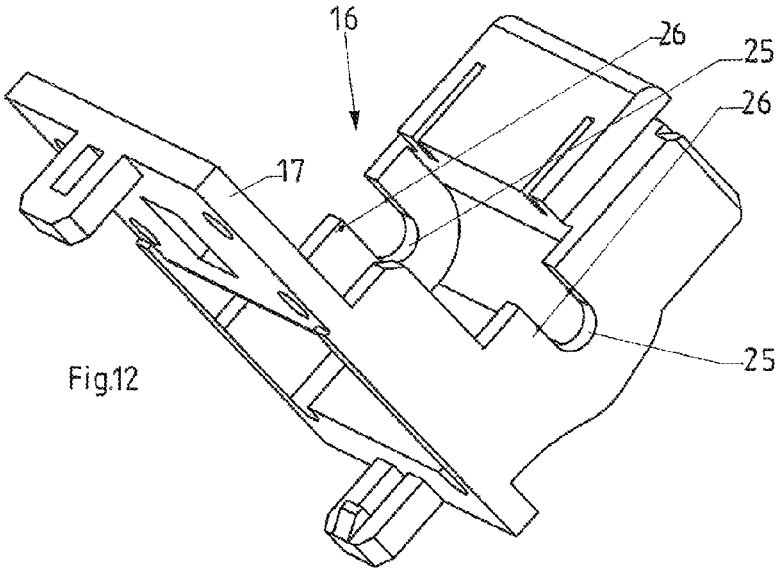
Fig.12

TELECOMMUNICATION OR DATA-TRANSMISSION JACK

FIELD OF THE INVENTION

The present invention relates to jack. More particularly this invention concerns such a jack as is used in telecommunication or data transmission.

BACKGROUND OF THE INVENTION

As described in DE 10 2004 011 358, a jack for telecommunication and/or data transmission systems has a metallic housing, a first printed circuit board fixed therein with connectors accessible from a lower face of the housing for electrical conductors, a plug seat for a plug communicating with the jack, a flexible, second printed circuit board having mutually insulated contact strips that forms jack contacts for contacts of the plug and that is fixed to the first printed is circuit board to form contact traces thereof, the contact strips being biased by a spring support in the housing so that the flexible second printed circuit board engages the first printed circuit board with a first end and forms the conductive traces thereof.

In the known jack, a flexible printed circuit board is combined with a rigid printed circuit board. The flexible printed circuit board has two ends that are fixed on one side to the printed circuit board and on the other side to the jack. Between these ends, a central region is designed as a contact area forming a group of exposed contact strips that are spaced laterally apart. These form the mechanical connection between the two end portions and create the jack contacts for engagement with the contacts of a plug inserted into the jack.

In the jack, the area with insulated contact strips is for contacting the plug contacts inserted in the jack by disk-shaped guiding and positioning elements, on each of which is supported a corresponding conducting path section from the group of contact strips. The contact strips are also separated from one another by these elements. The guide elements are fastened by a flexible support arm on the cover of the jack, and a leaf spring is also provided as a supporting and springing element.

In this configuration, the contact points of the insulated contact strips with the corresponding plug contacts are separated relatively widely from the corresponding printed circuit board, which leads to poor transfer characteristics with regard to control signals and the like delivered via the plug contacts. In addition, relative movement between the piece is supporting and separating the insulated contact strips and the contact strips thereof occurs. This can lead to undesired wear in the region of the insulated contact strips, and thus to reduced transmission quality.

As is well known from the prior art, the individual contact strips can be one-sided, that is covered on the underside or the upper side by copper metal, which merges with the material layer of the end portion. The conductive traces and the contact strips may also be metal, in particular copper. In the uninsulated regions, which serve for making contact, the contact strips are coated with a well electrically conductive, corrosion-resistant material, for example gold.

OBJECTS OF THE INVENTION

It is therefore an object of the present invention to provide an improved telecommunication/transmission jack.

Another object is the provision of such an improved telecommunication/transmission jack that overcomes the above-given disadvantages, in particular that is improved with regard to the transmission characteristics of electrical signals and the like, and where wear of the insulated contact strips is also minimized.

SUMMARY OF THE INVENTION

A telecommunication or data-transmission jack has according to the invention a housing, a first circuit board forming a lower face of the housing, and connectors connected to traces of the first circuit board and projecting from the first circuit board downward at the lower face. A dielectric housing part forms with the housing an upwardly open seat shaped to receive and fit with a substantially complementary telecommunication or data-transmission plug. A second flexible circuit board has a U-shaped outer end formed with a plurality of conductive jack fingers projecting into the seat and positioned in the seat to engage respective contacts of the plug when the plug is fitted in the seat. The jack fingers are connected at an inner end of the second circuit board to the traces of the first circuit board. A U-shaped dielectric support fits complementarily within the U-shaped end of the second circuit board, has fingers like the jack fingers and fixed thereto, and is pivotal in the housing part between an inner position with the jack fingers spaced from an open end of the seat and an outer position between the inner position and the open end of the seat. A U-shaped leaf spring fits within the support, has fingers like the support fingers, bears outwardly on the support, and is braced against the housing part to bias the jack fingers into the outer position.

Because the U-shaped outer or second end bent through more than 180°, forms the short, jack fingers oriented parallel to one another such that a comb structure is formed and the fingers form the teeth of the comb, the contact points on these fingers are located as close as possible to the first end. Since the second end at the insulated fingers and at its bend is supported by a U-shaped support made of plastic that supports each of the individual fingers with freely extending stiff support fingers formed unitarily with the typically plastic support, and because the insulated fingers are fixed, for example glued, onto the fingers, relative movement between the support and the insulated fingers cannot occur, so that wear related thereto is excluded. So that the support is sufficiently movable during insertion of a plug and the suspension of the insulated fingers can deflect correspondingly, the support is held with bearing pins in a contact support that itself is fixed in the housing. The contact support itself forms a further outer support adjacent the inner support and adjacent the bent area of the flexible printed circuit board adjacent the insulated fingers, such that a further support for stabilization is formed here. In this area, the flexible printed circuit board is made of insulating material, in which fingers and the like are embedded. Wear of the outer layer of insulating material occurs only to a barely noticeable extent during intended use.

Finally, in order to strengthen the contact pressure, the first end of the leaf spring is inserted and fixed between a housing part and the housing and also extends via a bend to form spring fingers bearing against the support fingers that in turn carry the insulated spring fingers on the second end. An excellent and long-lasting suspension is hereby achieved, and the spring force is strengthened without promoting wear.

The axis formed by the bearing pins is oriented parallel to the centers of the fitted-together bends of the second board, support, and spring.

In its intended use, the support is pivotal about the bearing pins, so that a certain relative angular movement between the spring arm and the support can take place, however this is without meaning with regard to the insulated jack fingers of the second printed circuit board as the flexion is so minor that their ability to conductive signals remains unchanged regardless of position.

In general, the jack according to the invention has excellent transmission characteristics that meet the requirements of Category 8 and in which wearing of the contacting elements is also largely prevented such that long-term operation and long service life is ensured.

In particular, the second circuit board has eight side-by-side jack fingers, as is typical of an RJ45 connector. Such a configuration serves for the corresponding insertion of an RJ45 data-transmission plug 45 having eight corresponding plug contacts, each formed by a conductor lying in a respective one of eight grooves extending in the insertion/extraction.

In order to limit pivoting of the support, the support has coaxial part-cylindrical bearing pins end and converging stop faces projecting therefrom, and the contact support has matching part-cylindrical notch seats with parallel notch flanks or faces extending outward therefrom, so pivoting of the support is limited, with a first stop face lying against a first parallel seat face in a first end position and a second stop face lying against a second parallel notch face in a second end position.

In order to prevent that such a jack from being damaged by insertion of a non-permitted plug, in particular an RJ11 or RJ12 plug, the contact support is arranged or formed in alignment with the first and the eighth jack fingers, that is the two opposite end contacts of the eight-contact row, a respective latch tooth that extends past the face of the contact support between the respective jack finger and the open outer end of the seat of the first and eighth jack fingers projecting into the jack seat.

This configuration ensures that when plugging in an allowed plug RJ 45, all eight plug contacts can contact the corresponding fingers because such a plug has a groove holding each contact and the latch tooth at the first and the eighth groove can slide past without blocking parts of the plug. If, however, an incorrect six- or four-conductor plug of type RJ11 or RJ12 is plugged in, this plug can thus only be inserted up to the latch teeth, as the plug has no grooves (and no plug contacts) at the latch teeth, so that insertion of the plug is blocked, avoiding damage to the jack.

The latch tooth can also be formed on the contact support. It is, however, also possible to provide a pocket in the contact support in which a corresponding latch tooth can be used such that it is held captive there. In this case, the latch tooth can also be made from another material. For example, the latch tooth can be made of metal.

Also according to the invention the first end of the second, flexible printed circuit board is provided with an embedded electrotechnical compensation circuit, resonance dampening circuit and/or additional or other means that improves electrical transmission properties or somehow amplifies, limits, or otherwise affects the signal being transmitted.

BRIEF DESCRIPTION OF THE DRAWING

The above and other objects, features, and advantages will become more readily apparent from the following description, reference being made to the accompanying drawing in which:

FIGS. 8-12 are isometric views of further elements of the inventive jack.

SPECIFIC DESCRIPTION OF THE INVENTION

Figure 1:
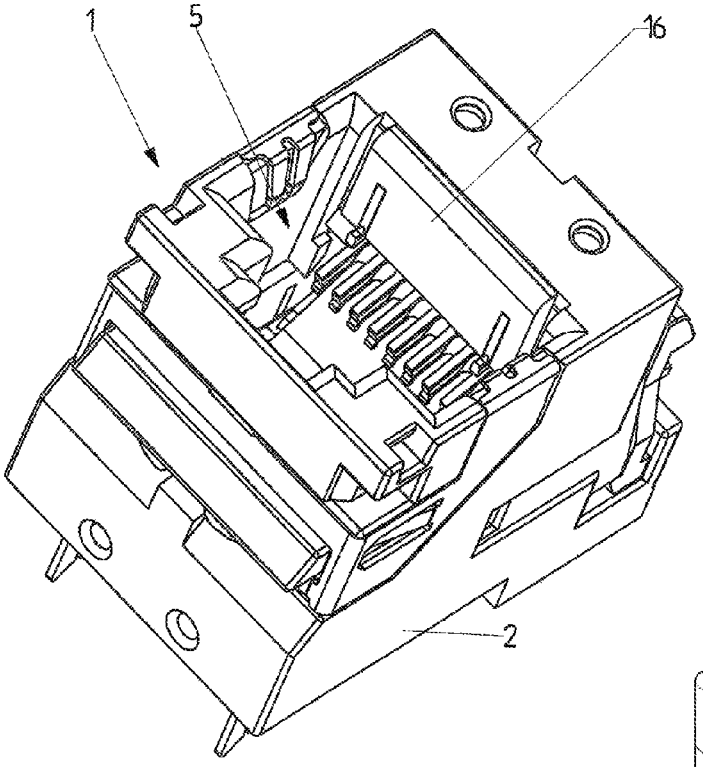
FIG. 1 is an isometric view from above of a jack according to the invention.
Figure 2:
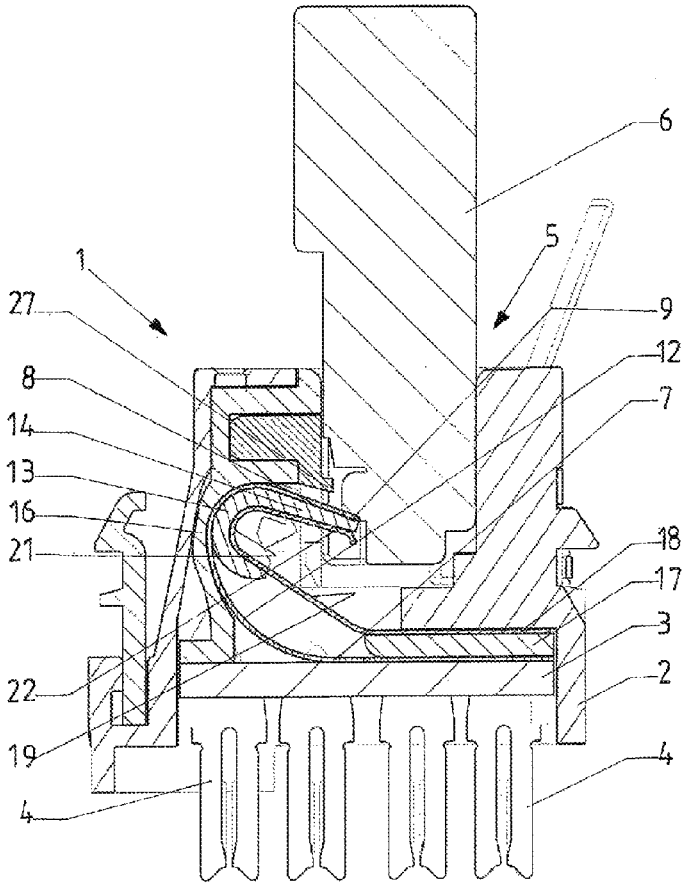
FIG. 2 is a section through the jack with a RJ45 plug partially inserted in it.

As seen in the drawing, a jack 1 for telecommunication and/or data-transmission systems comprises a metallic housing 2 preferably made of pressure die-cast zinc. The housing 2 holds a printed circuit board 3 carrying eight spreadable electrical connector blades 4 adapted to be connected to, for instance, the eight conductors of a CAT5 cable. These connectors 4 are accessible on a lower face of the housing 2 as shown in FIG. 2, although of course the orientation shown here relative to the vertical could be changed with, for instance, the connectors 4 pointing upward or to the side. The opposite side of the housing 2 has a plug seat 5 opening on the housing upper face and serving to hold a complementary plug 6 (FIGS. 2-3) in the correct position in the jack 1, so that its plug contacts thereof engage contacts of the jack 1. Such a plug 6 typically is formed on one side with eight grooves that extend in the insertion/retraction direction (up/down in FIG. 2), that open outward transversely to this direction, and that each hold a respective conductor formed normally by a copper wire.

Figure 8:
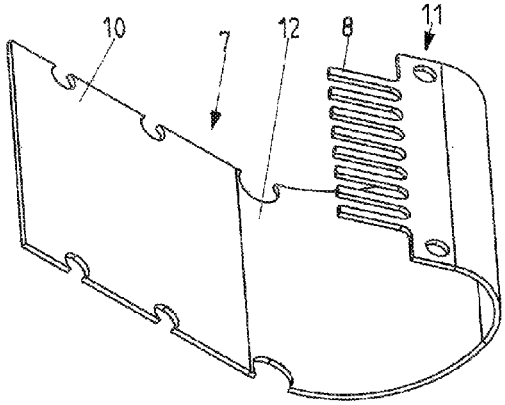

Furthermore as shown in FIG. 8, a flexible second printed circuit board 7 is mounted in the housing 2 as a separate part. This flexible second printed circuit board 7 has electrically mutually insulated fingers 8 that form jack contacts 9 for contacting the plug 6. To this end the flexible board 7 has copper traces that extend out and form the fingers 8. The flexible second printed circuit board 7 is fixed to the first printed circuit board 3 and connected thereto by the contact traces thereof in a suitable manner known per se. As will be explained later, the contact fingers 8 are supported by spring and support means provided in the housing 2.

The second flexible printed circuit board 7 is fixed with a first end 10 to the first printed circuit board 3, and contacted by the conductive traces thereof. In the desired installation position, an opposite second end 11 separated by a central region 12 from the first end 10 is U-shaped and bent over through more than 180° as shown in FIG. 2, and its outer edge carries the short jack fingers 8 extending parallel to one another and that in the desired installation position project into the plug seat 5 so as to be able to fit in the grooves of the plug 6. These fingers 8 are very short, which is advantageous for electrical signal transmission.

Figure 9:
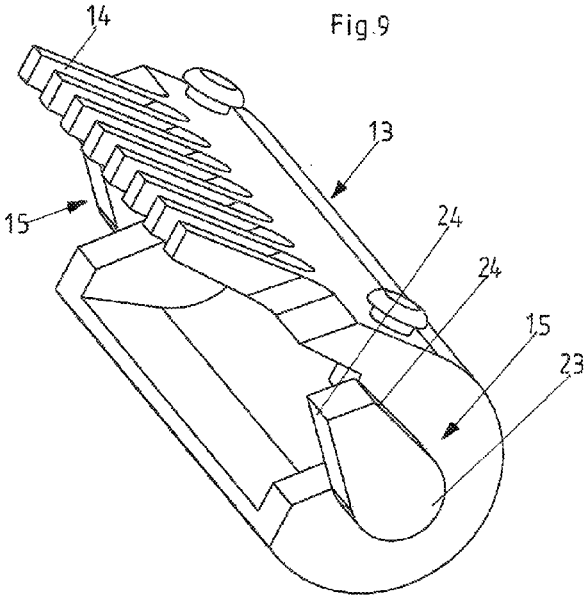

The second end 11 is supported at a part of the bend 12 and at the insulated fingers 8 by a rigid U-shaped support 13 made of insulating material as shown in FIG. 2 and all alone in FIG. 9. This support 13 has free projecting support fingers 14 each carrying a respective one of the insulated contact fingers 8 of the second board 7 and on which in the desired installation position the insulated fingers 8 rest and are fixed, for example by glue. Relative movement between the parts 8 and 13 is thus prevented.

The support 13 has bearing pins 15 by means of which it is limitedly pivotable in a contact support 16 shown in detail in FIG. 12 and forming part of the housing 2. The contact support 16 forms a part-cylindrical seat that partially surrounds the region of the bend 12 on the surface facing away from the support 13 and supports the corresponding area of the second end 11 of the flexible printed circuit board 7. The support 16 has another part 17 carrying the first end 10 of the second printed circuit board 7. This end 10 bears against the first printed circuit board 3 as shown in FIG. 2 and presses it against the housing 2.

Figure 6:
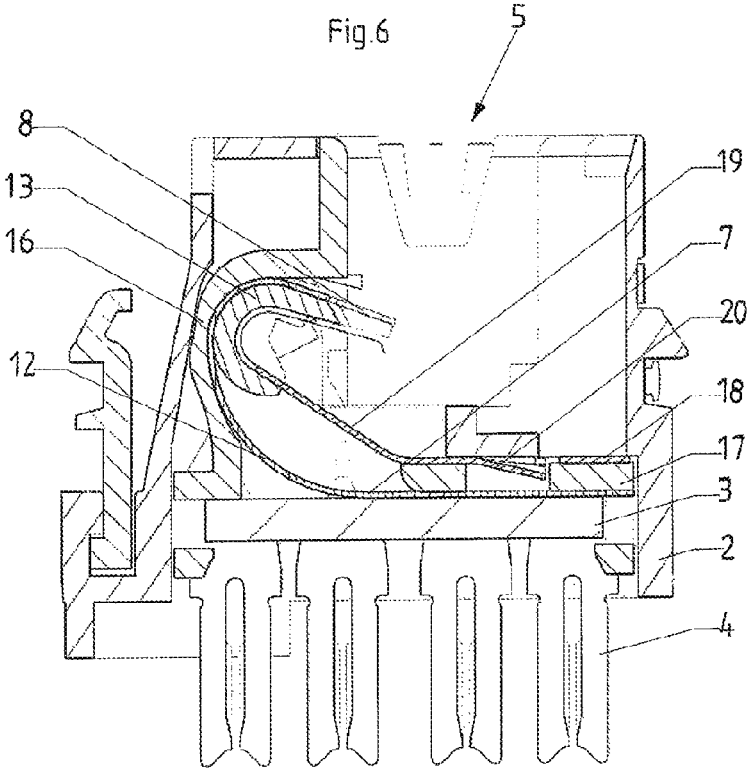
FIG. 6 is a section like FIG. 2, but with no plug inserted.
Figure 7:
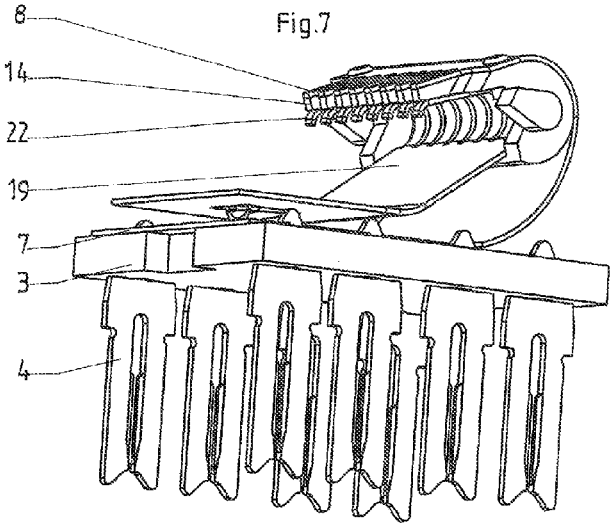
FIG. 7 is an isometric view from below of details of the jack.

A first end of a J- or U-shaped leaf spring 19 is fixed between a part of the housing 2 and the part 17 of the contact support 16. This leaf spring 19 is shown all alone in FIG. 10. It has a bent-out locking or retaining tab 20 shown in FIG. 6 that fits in a recess of the part 17 to lock it in place. The leaf spring 19 also has a bend 21 from which extend spring fingers 22 that flank the support fingers 14 with the contact fingers 8. Thus these spring fingers 22 bear via the fingers 14 of the support 13 on the mutually insulated contact jack finger 14 respective thereto on the side opposite the insulated fingers 8. This is shown for example in FIG. 2. All the comb-like fingers 8, 14, and 22 are of the same outline. The second printed circuit board 7 has eight of the insulated fingers 8. Similarly, the support 13 has eight corresponding fingers 14, and the leaf spring 19 eight corresponding spring fingers 22.

The bearing pins 15 have as shown in FIG. 9 rounded ends 23 and a radially projecting stop arm with converging flat stop faces 24. The contact support 16 has U-shaped notch seats 25 with rounded ends and parallel side faces 26 extending outward therefrom. When the bearing pins 15 are inserted into the recesses 25 the support 13 can pivot within accurately defined limits. In an inner end position shown in FIG. 3 a first connecting surface 26 is located against a first stop face 24 parallel thereto, while in an outer end position shown in FIG. 4 the second face 26 bears against the second stop face 24 parallel thereto.

Figure 3:
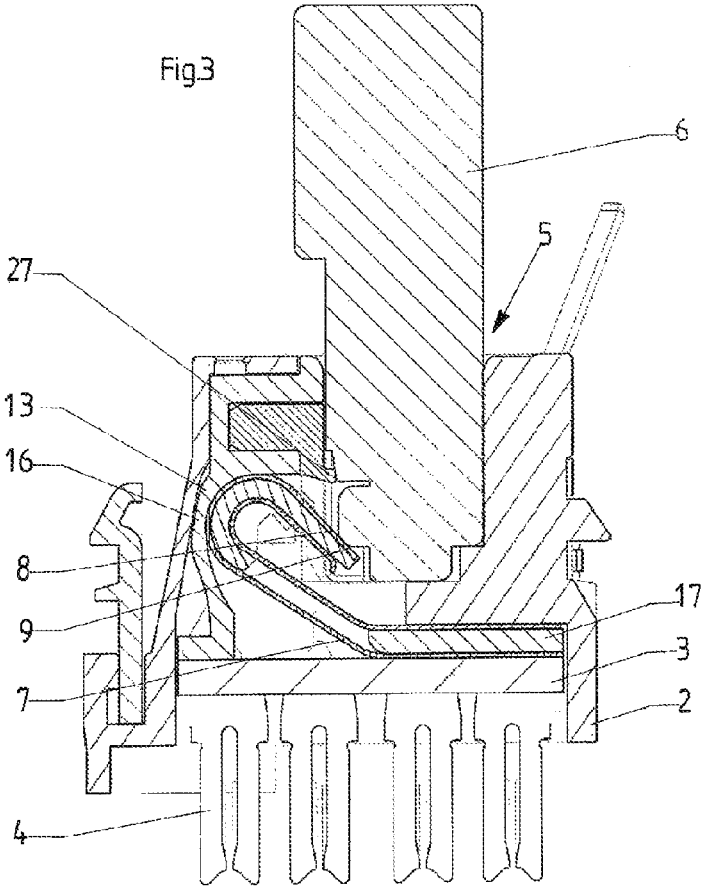
FIG. 3 is a view like FIG. 2, but with the RJ45 plug fully inserted.
Figure 4:
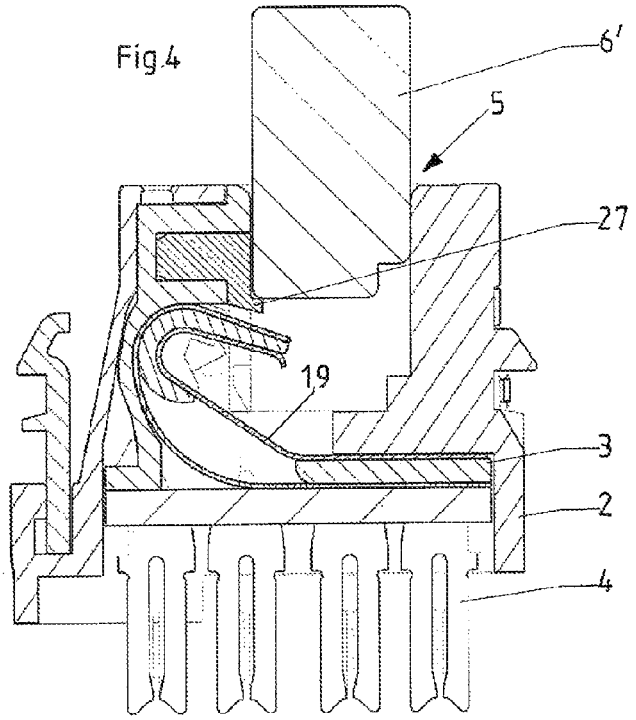
FIG. 4 is another view like FIG. 2, but with an RJ11 or RJ12 plug.
Figure 5:
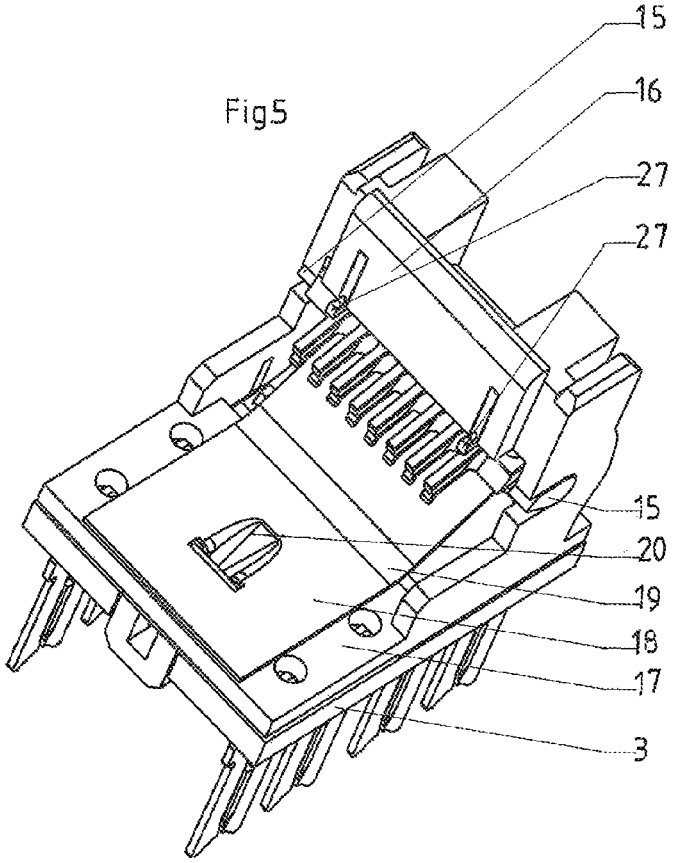
FIG. 5 is an isometric view from above of a part of the jack.

At the seat 5, the contact support 16 has two respective latch teeth 27 aligned with the first and the eighth contact fingers 8. Each latch tooth 27 extends from the contact support 16 into the jack seat 5. The design is such that an RJ45 plug can be plugged in, as shown in FIGS. 2 and 3, because the latch tooth 27 can fit in a contact groove formed at the first and eighth contacts of the plug 6. If in an impermissible manner a six- or four-conductor RJ11 or RJ12 plug 6' is inserted as shown in FIG. 4, since no grooves are provided on the corresponding plug 6' because there are no first and eighth plug contacts, the plug 6' abuts the latch tooth 27 and cannot engage fully in the seat 5. Thus damage to the corresponding plug contacts 1 and 8 is not possible.

In the embodiment according to the invention the first end 10 of the flexible printed circuit board 7 or also the area of the bend 12 adjacent the insulated fingers 8 is provided with imbedded electronic compensation means, resonance damping means and/or additional or other means that improve the electrical transmission properties.

In the embodiment according to the invention, during intended use, i.e. when a plug 6 is in the seat 5, contact with the jack fingers 8 is achieved in at their contacts 9, and the region of the bend 12 is bent from the position shown for example in FIG. 4 into the position shown in the final inserted position in FIG. 3. No relative movement occurs between the support 13 and the fingers 14 thereof and the jack fingers 8, but instead these parts are firmly connected to one another. At most there may be relative movement between the bent region of the leaf spring 19 and the support 13, which however is not harmful in terms of wear. The leaf spring 19 and the support 13 ensure good positioning and pressing by the jack fingers 8 in the contact area, so that good contact with the plug contacts of the inserted plug 6 is achieved. A low-wear design of the jack 1 is thereby achieved, which satisfies high standards, in particular the so-called Cat 8 standards.

The invention is not limited to the described embodiment, but rather the scope of the disclosure is multiplicatively variable. All combinative features disclosed in the specification and/or drawings are considered essential to the invention.

I claim:

1. A telecommunication or data-transmission jack comprising:

a housing;

a first circuit board carrying traces and forming a lower face of the housing;

connectors connected to the traces of the first circuit board and projecting from the first circuit board downward at the lower face;

a dielectric housing part forming with on the housing an upwardly open seat shaped to receive and fit with a substantially complementary telecommunication or data-transmission plug;

a second flexible circuit board having a U-shaped outer end and an inner end, the outer end being formed with a plurality of conductive jack fingers projecting into the seat and positioned in the seat to engage respective contacts of the plug when the plug is fitted in the seat, the jack fingers being connected at the inner end of the second circuit board to the traces of the first circuit board;

a U-shaped dielectric support fitting complementarily within the U-shaped end of the second circuit board, having fingers extending along the jack fingers and fixed thereto, the fingers of the jack and of the support being pivotal in the part between an inner position with the jack fingers spaced from an open end of the seat and an outer position between the inner position and the open end of the seat; and a U-shaped leaf spring fitting within the support, having fingers extending along the support fingers and bearing outwardly thereon, and braced against the part to bias the jack fingers into the outer position.

2. The jack defined in claim 1, wherein there are eight of the jack fingers in a row.

3. The jack defined in claim 1, wherein the support is formed with aligned bearing pins seated in the part and defining a pivot axis for the support, the support and being formed with angularly directed stop faces permitting only limited pivoting of the support in the part for movement of the jack fingers between the inner and outer positions.

4. The jack defined in claim 1, wherein there are eight of the jack fingers, the jack further comprising:

latch formations in the part and projecting into the seat at a level between the outer position of the jack fingers and the open end of the seat and in an orientation to engage in grooves of end contacts of the plug.

5. The jack defined in claim 1, wherein the second board includes signal-processing means connected to the respective jack fingers.

6. The jack defined in claim 1, wherein the housing is of metal.

* * * * *